United States Patent [19]

Rosenzweig

[11] 4,259,891

[45] Apr. 7, 1981

[54] MULTI-BARREL ROTARY MACHINE GUN

[76] Inventor: Shlomo Rosenzweig, 24 Hatomer St., Ramat Hasharon, Israel

[21] Appl. No.: 28,647

[22] Filed: Apr. 10, 1979

[30] Foreign Application Priority Data

Apr. 14, 1978 [IL] Israel ..... 54510

[51] Int. Cl.[3] ..... F41D 7/02

[52] U.S. Cl. ..... 89/12

[58] Field of Search ..... 89/9, 10, 11

[56] References Cited

U.S. PATENT DOCUMENTS

| | | | |
|---|---|---|---|
| 563,701 | 7/1896 | Wilder | 89/11 |
| 3,311,022 | 3/1967 | Bernard et al. | 89/12 X |
| 3,611,866 | 10/1971 | Jacolucci et al. | 89/12 |
| 3,611,871 | 10/1971 | Kirkpatrick et al. | 89/12 X |
| 3,722,356 | 3/1973 | Tassie et al. | 89/11 |
| 3,766,821 | 10/1973 | Cozzy et al. | 89/12 |
| 4,166,407 | 9/1979 | Ashley et al. | 89/12 |

*Primary Examiner*—David H. Brown

*Attorney, Agent, or Firm*—Dennison, Meserole, Pollack & Scheiner

[57] ABSTRACT

A multi-barrel rotary machine gun comprising a stationary internal shaft around which a drum carrying a plurality of barrels is rotatably arranged, a bolt assembly and locking mechanism is associated with each barrel, and the movement of each bolt assembly and its operation is dictated by a slot in the drum and a cam groove on the shaft.

1 Claim, 13 Drawing Figures

MULTI-BARREL ROTARY MACHINE GUN

The present invention concerns a multi-barrel rotary machine gun. Many multi-barrel rotary machine guns are known which, however, all comprise a rotating central shaft for receiving and firing automatically a succession of cartridges housed in bolts. Owing to the fact that the central shaft rotates during firing, special bearings and supporting means have to be provided for the shaft to enhance the accuracy of the firing. Nevertheless, vibrations occur at all times which influence the accuracy of firing. Furthermore, these known multi-barrel rotary machine guns are made of many parts and require a heavy housing which all make the transport, mounting and handling of these guns quite difficult.

It is the object of the present invention to provide a multi-barrel rotary machine gun which is of much simpler construction than this type of gun known up to now and is, therefore, both cheaper in manufacture and maintainance and lighter in transport.

It is a further object of the invention to provide a multi-barrel rotary machine gun which has a high firing rate with very high firing accuracy.

The invention consists in a multi-barrel rotary machine gun comprising a stationary internal shaft around which a drum carrying a plurality of barrels is rotatably arranged, a bolt assembly and locking mechanism being associated with each barrel, the movement of each bolt assembly and its operation being dictated by a slot in said drum and by a cam groove provided on said shaft.

The invention is illustrated, by way of example only, in the accompanying drawings, in which.

Figure 12:
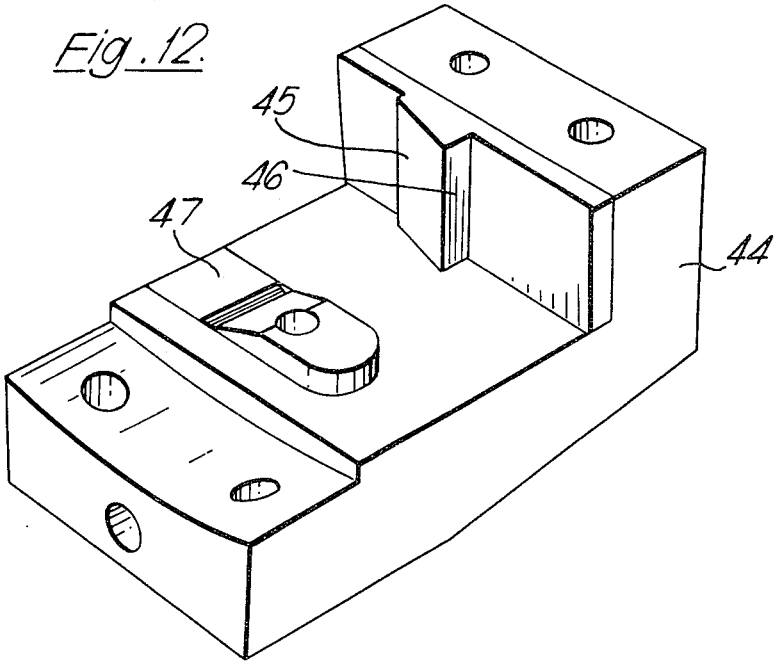
Figure 10:
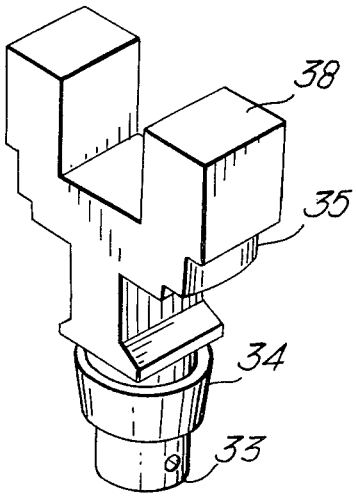
Figure 10A:
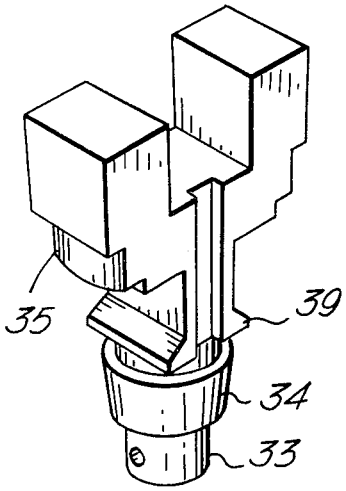
Figure 11:
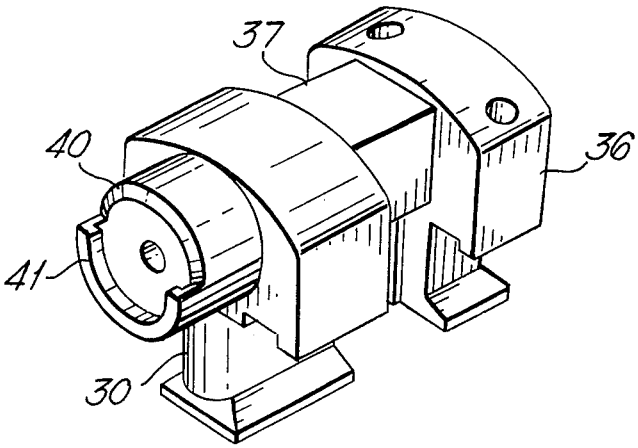

FIGS. 10, 10*a* are perspective views of the locking fork in positions rotated 90° relative each other;

FIG. 11 is a perspective view of the bolt body in position to receive the locking fork shown in the position of FIG. 10;

FIG. 12 is a perspective view of the striker base and accellerator mechanism.

For the sake of the present illustrations a multi-barreled gun with six barrels, six bolts and cartridge firing positions is described, it being understood at the outset that it is within the scope of the present invention to provide more or less than six barrels and their associated mechanisms with any desirable caliber.

Figure 1:
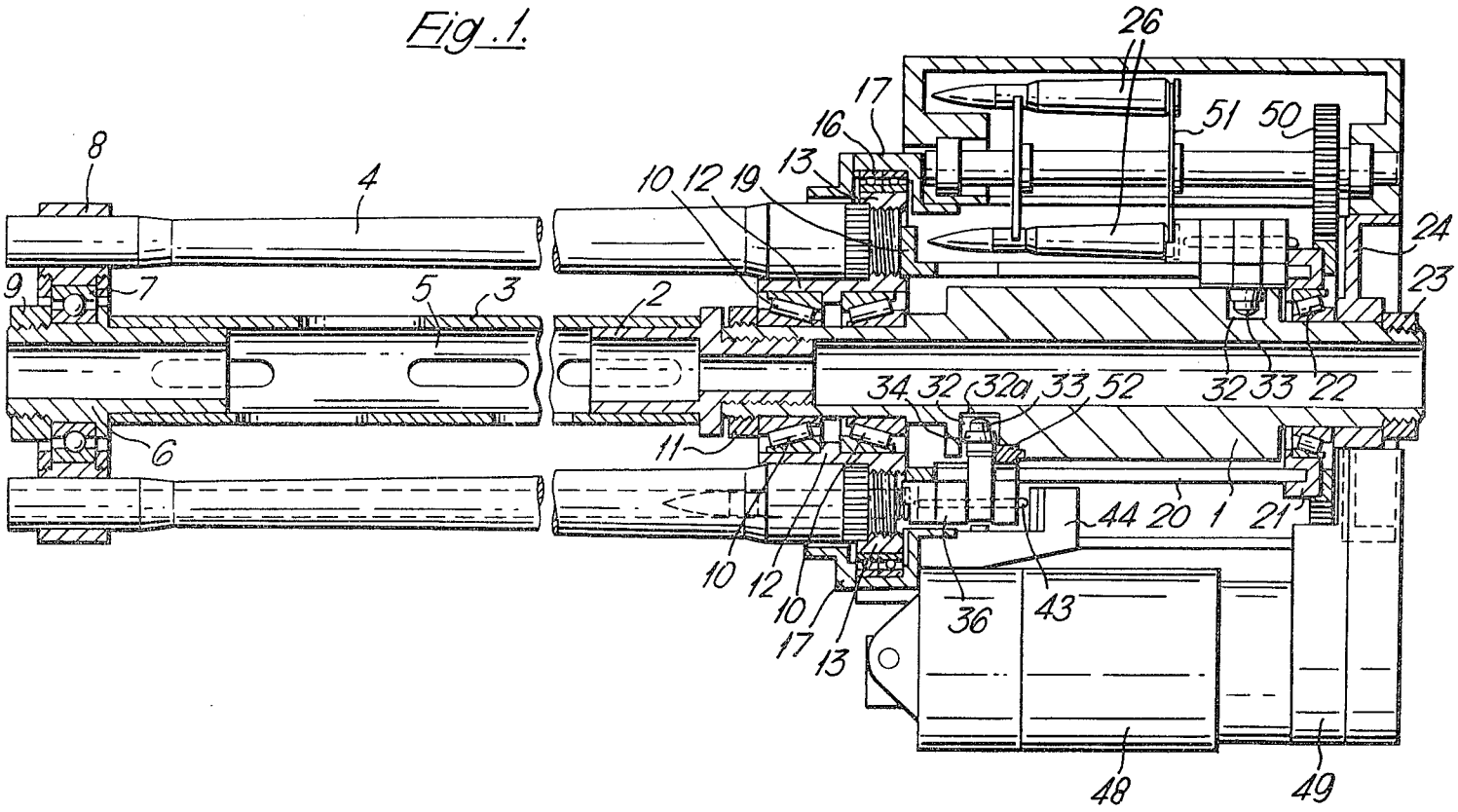
FIG. 1 is a longitudinal section of the multi-barrel rotary machine gun according to the invention, parts which are of secondary importance being shown schematically, while other parts which are not parts of the invention have been left out.

As seen in FIG. 1 the multi-barrel rotary machine gun according to the invention comprises a stationary fixed hollow internal shaft 1 whose construction will be described hereinafter. A sleeve 2 is adapted to be screwed into the front of shaft 1, a supporting tube 3 for the barrels 4 having cut outs 5 in its walls for reducing its weight being welded to the front end of sleeve 2.

Figure 4:
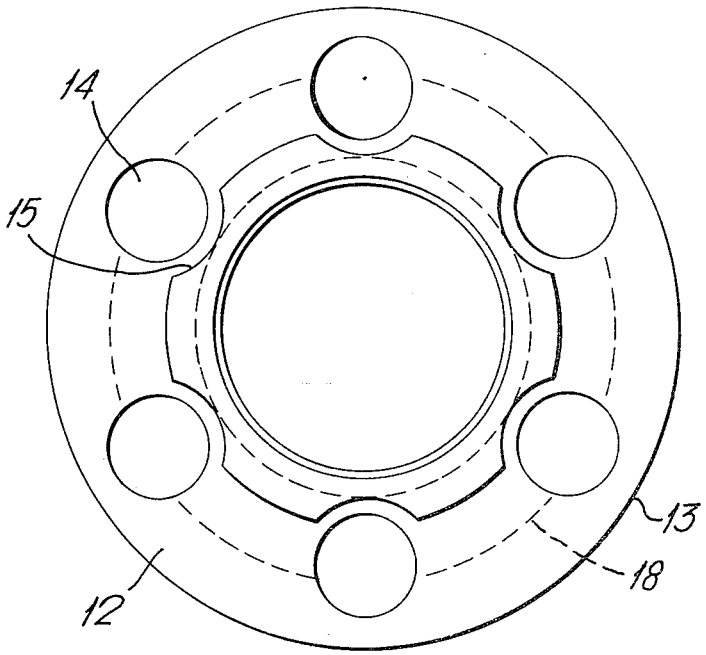
FIGS. 4 and 5 are an end view and cross-section, respectively, of the front bushing.
Figure 5:
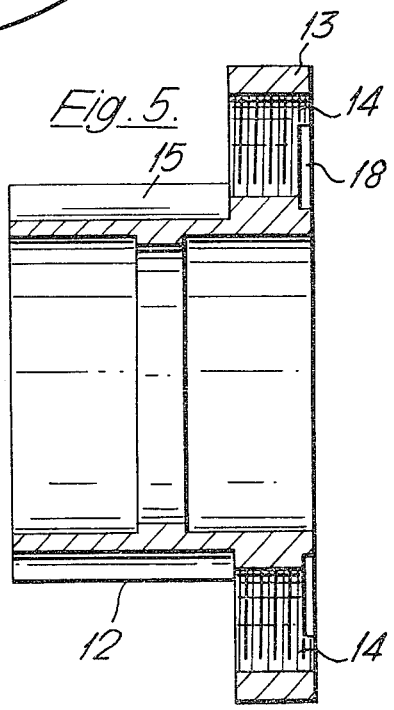

Into the front end of tube 3 a bearing support sleeve 6 is welded, said sleeve providing a seat for bearings 7. Said bearings rotatingly support barrel supporting rings 8 at the front end of the gun, the ring being provided with six cylindrical cut outs for that purpose. A nut 9 fixes the bearings on the threaded front end of bearing support sleeve 6. On the front end of shaft 1 a pair of cone bearings 10 are mounted which are locked in place thereon by a locknut 11, threaded on to the outer end of shaft 1. Said cone bearing rotatingly support a shaft front bushing 12 which is illustrated in greater detail in FIGS. 4 and 5. This bushing is substantially cylindrical having at its rear end a plate 13 provided with six cylindrical apertures 14 into which the rear end of the barrels 4 are screwingly mounted. The barrels are supported in sutably arcuate-shaped cut-outs 15 in the cylindrical wall of said front bushing 12. Thus, the front bushing 12 is adapted to rotate around the shaft 1 together with the barrels 4. On the other periphery of plate 13 slim bearings 16 are mounted which are supported in an annular bushing support housing 17. Thus housing 17 supports the entire gun in a conventional gun mount (not shown) with the interposition of suitable shock absorbers, as known per se. An annular groove 18 is provided in the rear face of flange 13 in which the front flange 19 of drum 20 is disposed. Said drum, which thus rotates relative shaft 1 owing to its mounting in plate 13, is substantially constituted by a cylinder having said flange 19 at its front end, its cylindrical body being mounted at its rear end in an annular drum closing member 21 which by means of bearings 22 is also rotatable relative to shaft 1. Bearings 22 are held on shaft 1 by means of a rear plate 24 locked to the shaft by lock nut 23 which is screwed onto the reduced threaded end of the shaft.

Figure 6:
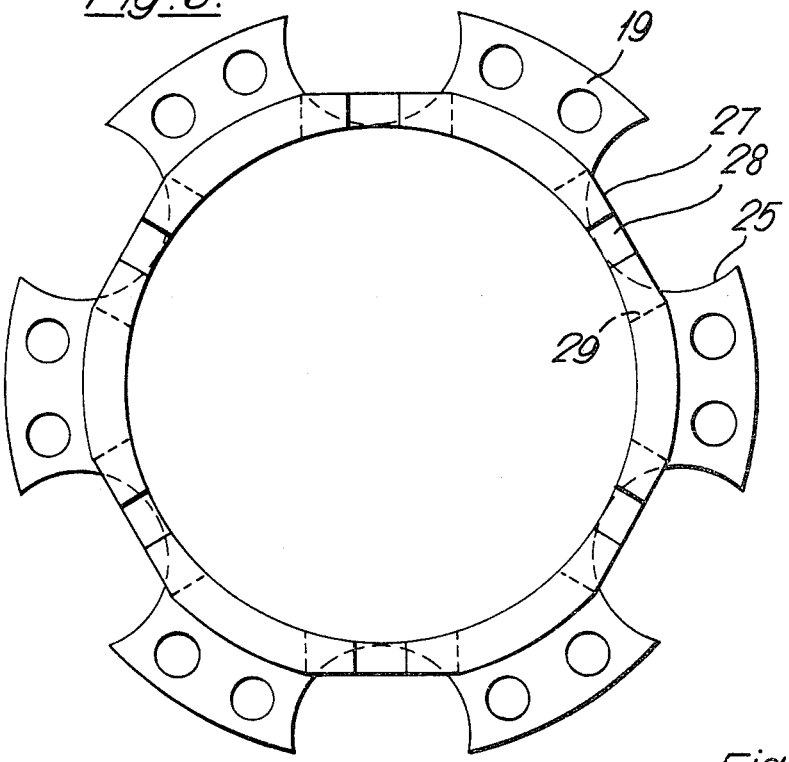
FIGS. 6 and 7 are, respectively, an end view and side view of the drum.
Figure 7:
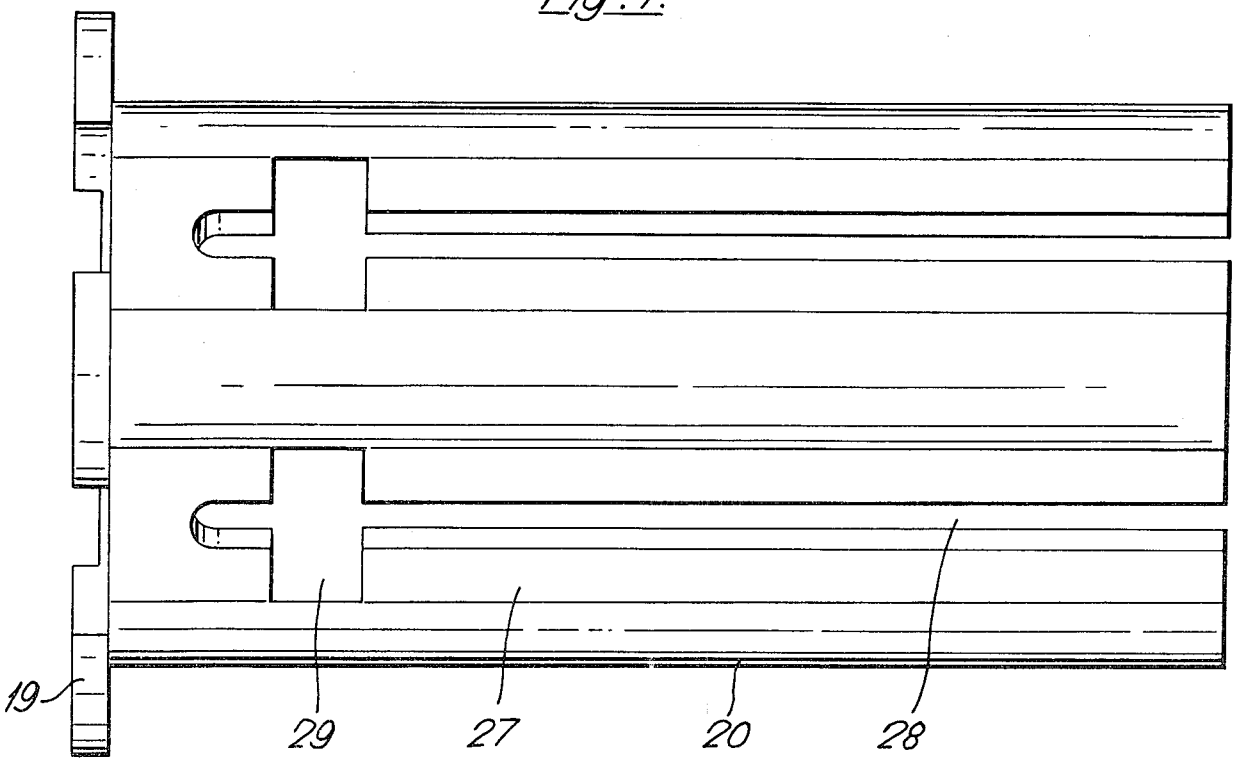
Figure 9:
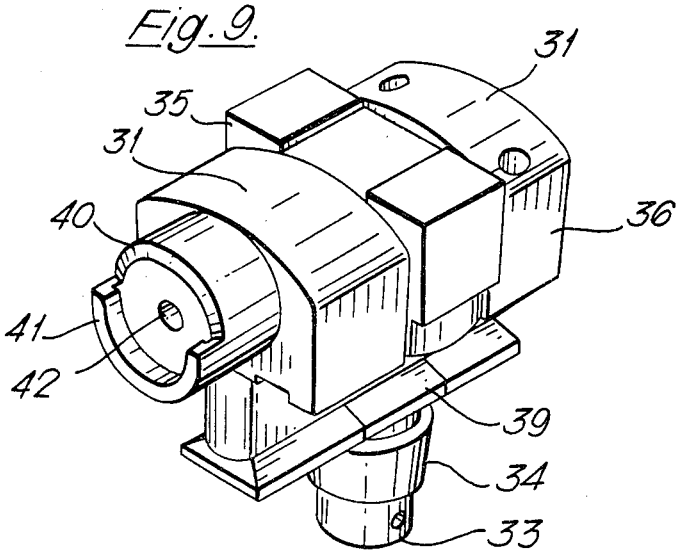
FIG. 9 is a perspective view of the bolt assembly and its locking mechanism.

The front flange 19 of drum 20 is provided with six cut-outs 25 (FIGS. 6 and 7) adapted to permit cartridges 26 to pass therethrough. Longitudinally aligned with cut-outs 25 the wall of drum 20 is flattened at 27 and is provided with six through-going guiding slots 28 which near their front end merge into transverse openings 29 extending across the entire flat face 27.

Figure 2:
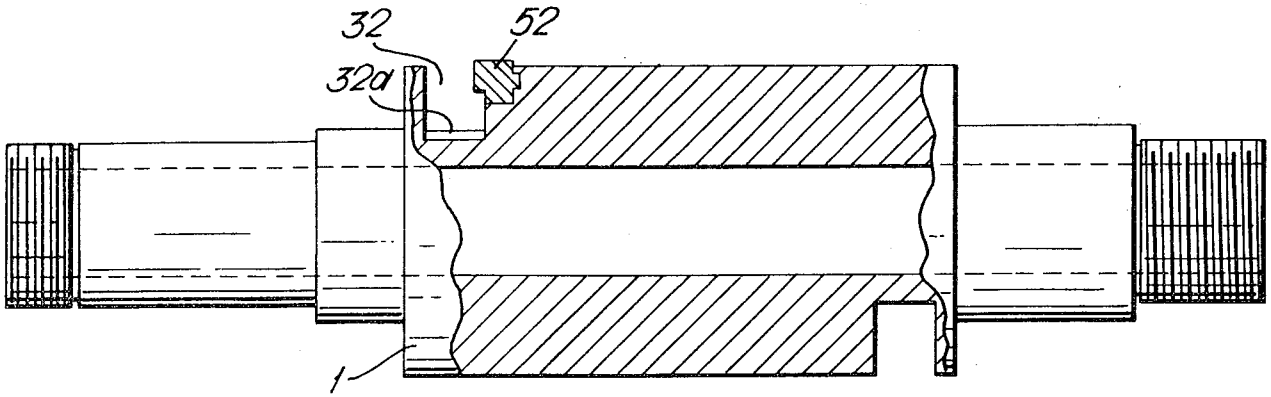
FIG. 2 is a plan view, partly in section, of the internal shaft.
Figure 3:
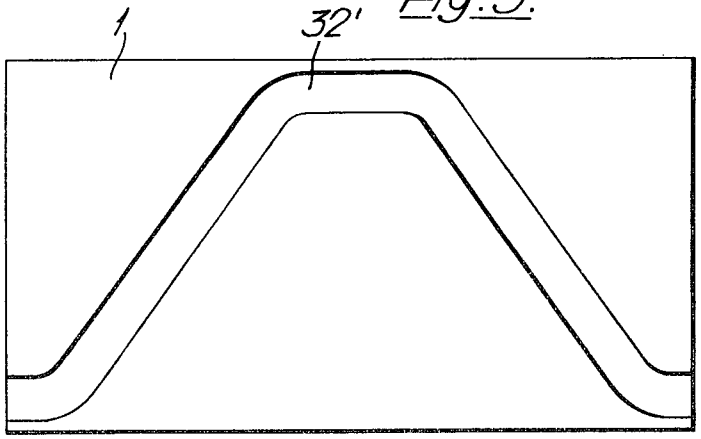
FIG. 3 is a developed view of the cam section of said shaft.

The slots 28 (FIG. 7) are provided to guide the longitudinal reciprocating movement of the bolt assembly, generally indicated by 31, in that the leg 30 (FIG. 11) of said assembly is movable therein. The control of said reciprocating movement as the drum rotates around shaft 1, is effected by a cam groove 32 provided on the outside of shaft 1 (FIGS. 2 and 3) in that the sliding head 33 and roller ring 34 of the locking fork, generally indicated at 35 and associated with the bolt assembly extend into said cam groove 32.

The bolt assembly 31 comprises a body 36 above leg 30, the body being curved at the outside and having a cut-out portion intermediate its ends in such a manner that a block 37 of substantially square profile is formed for the up and down movement thereon of the bifurcated ends 38 of locking fork 35. The stem of said locking fork 35 has an integral abutment projection 39 above its roller 34 and sliding head 33. At one end, i.e. the front of bolt body 36 an integral cylindrical axial extension 40 is provided having at its free end an undercut semi-annular groove 41 for holding the conventionally shaped end of a cartridge 26 therein. An axial through-going bore 42 is provided in the bolt body 36, said bore holding the conventional striker 43 therein. A striker base support 44 (FIGS. 1 and 12) is mounted on the machine gun at the bottom of support housing 17. Said striker base support 44 comprises a body of substantailly L-shaped profile having on its web a ramp-like striker base 45 which at its higher end merges into a face 46 perpendicular to said web. On the leg of said L-shaped base a ramp 47 is provided, said ramp 47 being hereinafter called lock accelerator.

The machine gun is driven by a motor 48 and gears 49 mounted between the housing 17 and the back plate 24. The motor, with the interposition of the gears, drives gear 50 keyed to drum 20. Said gear also drives the conventional cartridge feed mechanism generally indicated at 51.

Figure 8:
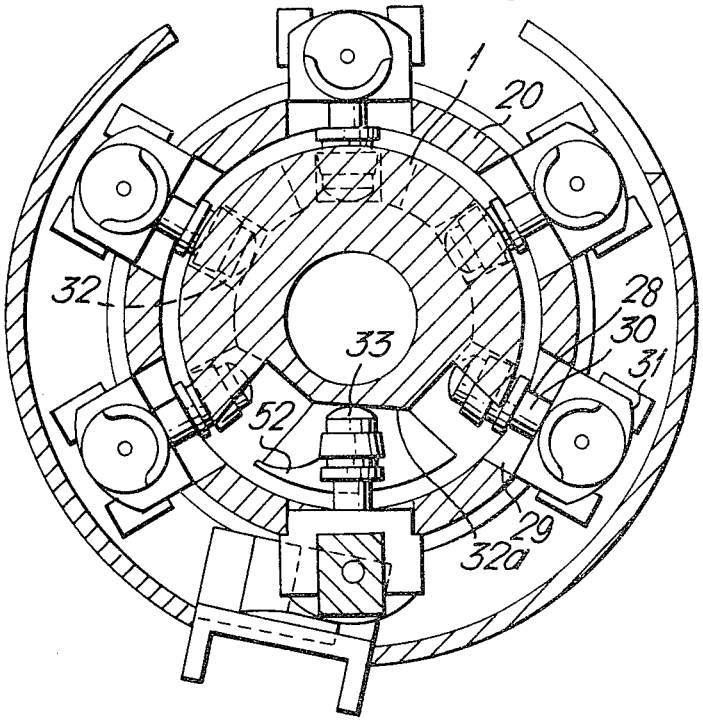
FIG. 8 is an assembly drawing, partly in cross-section of the assembly of the shaft, drum and bolts.

The operation of the machine gun is as follows:

The transfer wheel of the cartridge feed mechanism takes a cartridge 26 from the feed belt or magazine, all as known per se, and delivers it to a bolt assembly so that the rear end of said bolt sits in groove 41. At this stage the bolt assembly is located at 12 o'clock position (FIG. 8) when seen from the rear of the gun. Owing to the rotation of drum 20 and to the groove 32 in shaft 1, the bolt assembly is rotated clockwise while the tip of the cartridge enters its corresponding barrel, the movement of the bolt assembly being guided by groove 28 of the drum. In the position which corresponds to approximately 5 o'clock, the bolt assembly which now is substantially upside down when compared to its starting position, has reached the position wherein a locking cam 52, which is mounted on the shaft, engages the locking fork below roller 34. At this point the bolt assembly is locked on the drum and its position is in the part 32' of cam groove 32, which extends perpendicular to the axis of the shaft. Now the striker 43 hits base 45 firing the shot at about 6 o'clock, suitable shock absorbers being provided for absorbing the recoil of the gun, as known. Simultaneously, the curved part of the sliding head 33 rides on the flat surface of a delocking cam section **32*a* which is part of groove 32 and lifts the locking fork in opening 29 so that the bolt can again enter into slot 28, the rotation of the drum causing the return of the bolt assembly by way of cam groove 32**.

During the return movement of the bolt assembly the empty cartridge hits the known extractor finger, not shown, to be removed from the bolt assembly, said finger being part of the conventional cartridge feed mechanism.

After the bolt has returned into 12 o'clock position, it picks up a new cartridge and a new cycle is started.

During one revolution of the drum six cartridges are fired. The motor and the entire firing mechanism rotates at 600 revolutions per minute, so that every barrel shoots 600 times per minute, i.e. 3600 shots per minute can be fired by the gun according to the invention.

I claim:

1. A multi-barrel rotary machine gun comprising a stationary internal shaft, a drum mounted for rotation about said shaft, a plurality of barrels carried by said drum for rotation therewith, a bolt assembly and locking mechanism associated with each barrel, and means for dictating the movement of each bolt assembly and its operation, said means comprising a slot in said drum and a cam groove on said shaft.

2. A multi-barrel rotary machine gun as claimed in claim 1 including means engaging each locking mechanism with its associated bolt assembly for travel therewith, said cam groove comprising a section extending perpendicularly to the axis of said shaft, and a locking cam provided for engagement with each locking mechanism during travel of said bolt assembly in said section.

3. A multi-barrel rotary machine gun as in claim 1 wherein said shaft, drum and barrels include front and rear ends, a forwardly directed extension tube on the front end of said shaft, said extension tube having bearing means thereon providing support for the front ends of the barrels, and bearing means also supporting the rear ends of the barrels and the front end of the drum on said shaft.

4. A multi-barrel rotary machine gun as claimed in claim 1 or 3, wherein each bolt assembly comprises a body having a front adapted to receive and transport a cartridge, said body having a striker mounted axially therein, said body further including a reduced leg engaged in said slot in said drum.

5. A multi-barrel rotary machine gun as claimed in claim 4 including a striker base and a striker base support, each bolt assembly moving along said base to effect operation of the associated striker.

6. A multi-barrel rotary machine gun as claimed in claim 4 wherein each locking mechanism comprises a locking fork having a bifurcated end, each bolt body including a cut-out in which a bifurcated end engages, each fork including a stem having a roller and sliding head thereon, said roller and sliding head being engaged with said cam groove.

7. A multi-barrel rotary machine gun as claimed in claim 6, wherein said cam groove comprises a section extending perpendicularly to the axis of said shaft, and a locking cam being provided to engage said locking mechanism during travel of said bolt assembly, in said section.

* * * * *